US011029114B2

(12) United States Patent
McDonald et al.

(10) Patent No.: US 11,029,114 B2
(45) Date of Patent: Jun. 8, 2021

(54) TRIGGER MECHANISM FOR FIREARMS

(71) Applicant: IRON HORSE FIREARMS, LLC, Salt Lake City, UT (US)

(72) Inventors: Ryan McDonald, Salt Lake City, UT (US); Kyle Hill, Farmington, UT (US)

(73) Assignee: Iron Horse Firearms, LLC, Salt Lake City, UT (US)

( * ) Notice: Subject to any disclaimer, the term of this patent is extended or adjusted under 35 U.S.C. 154(b) by 0 days.

(21) Appl. No.: 16/600,348

(22) Filed: Oct. 11, 2019

(65) Prior Publication Data

US 2020/0158457 A1 May 21, 2020

Related U.S. Application Data

(60) Provisional application No. 62/746,523, filed on Oct. 16, 2018.

(51) Int. Cl.

| | |
|---|---|
| ***F41A 19/10*** | (2006.01) |
| ***F41A 19/14*** | (2006.01) |
| ***F41A 19/07*** | (2006.01) |

(52) U.S. Cl.

CPC ..... *F41A 19/10* (2013.01); *F41A 19/07* (2013.01); *F41A 19/14* (2013.01)

(58) Field of Classification Search

CPC ..... F41A 19/07; F41A 19/10; F41A 19/14

See application file for complete search history.

(56) References Cited

U.S. PATENT DOCUMENTS

| | | | | | |
|---|---|---|---|---|---|
| 1,230,973 | A * | 6/1917 | Yeaton | F41A 19/07 | 42/41 |
| 3,210,879 | A * | 10/1965 | La Rue | F41A 19/07 | 42/69.01 |
| 4,010,566 | A * | 3/1977 | Edwards | F41A 17/52 | 42/69.01 |
| 4,070,783 | A * | 1/1978 | Edwards | F41A 17/52 | 42/69.01 |
| 5,274,939 | A * | 1/1994 | Scaramucci | F41A 19/45 | 42/69.03 |
| 5,560,133 | A | 10/1996 | Kuebler | | |
| 9,816,771 | B2 * | 11/2017 | Ghitti | F41A 17/24 | |
| 9,939,221 | B2 * | 4/2018 | Graves | F41A 19/16 | |
| 10,488,134 | B2 * | 11/2019 | Olson | F41A 17/56 | |
| 10,520,270 | B2 * | 12/2019 | Bair | F41A 19/09 | |
| 2005/0183317 | A1 * | 8/2005 | Finn | F41A 19/11 | 42/72 |

(Continued)

FOREIGN PATENT DOCUMENTS

| | | | | |
|---|---|---|---|---|
| DE | 102016004181 | | 10/2017 | |
| GB | 191304883 | A * | 1/1914 | F41A 19/07 |
| GB | 105076 | A * | 12/1917 | F41A 19/07 |

OTHER PUBLICATIONS https://www.brownells-deutschland.de/AR-15/M16-TACTICAL-TRIGGER-UNIT-TR-TT . . . Oct. 3, 2018.

(Continued)

*Primary Examiner* — Joshua T Semick

(74) *Attorney, Agent, or Firm* — Bateman IP

(57) ABSTRACT

A trigger mechanism for semiautomatic and automatic firearms may include a trigger body having a trigger which extends rearwardly toward the back of a pistol grip so that a user may fire the weapon by pressing downwardly on the trigger with the user's thumb.

19 Claims, 11 Drawing Sheets

(56) References Cited

U.S. PATENT DOCUMENTS

| | | | | |
|---|---|---|---|---|
| 2017/0350668 | A1* | 12/2017 | Angelis-Johns | F41A 19/09 |
| 2020/0080811 | A1* | 3/2020 | Harden | F41C 23/16 |
| 2020/0158457 | A1* | 5/2020 | McDonald | F41A 19/10 |

OTHER PUBLICATIONS https://www.thefirearmblog.com/blog/2015/03/09/taccon-releases the 241-trigger-system/ Oct. 3, 2018.

* cited by examiner

TRIGGER MECHANISM FOR FIREARMS

BACKGROUND

State of the Art

The present invention relates to a trigger mechanism for firearms. More specifically, the present invention relates to a trigger mechanism, with particular application for automatic and semiautomatic firearms.

Field of Art

In order to fire most firearms, the user places his or her index finger on the trigger of the weapon. As the trigger is pulled rearwardly, a hammer inside the firearm is released and either directly or indirectly (e.g., via a firing pin) strikes the primer or rim of the casing to thereby cause the powder charge to ignite and fire the bullet. For many people, use of the index finger is relatively easy and allows for a desirable firing rate. However, use of the index finger to actuate a trigger can have negative effects.

One disadvantage of using the index finger is that as the finger contracts and pulls the trigger, a slight rotational movement may occur in the user's hand which may cause the weapon to be deflected slightly and thereby interfere with obtaining a highly accurate shot. This is particularly true, in a high stress situation, such as where a person is subject to return fire.

Another disadvantage with using the index finger to actuate a trigger is that the mobility of the index finger is often reduced if the user's hand is cold. This can cause a slower reaction time and less ability to determine if the trigger has been properly pressed. While a shooter may wear a glove, the trigger guards for many firearms are small enough that they can interfere with the ability to freely use the index finger if a glove is being worn.

Yet another problem with the conventional location of triggers is that they are susceptible to being accidentally depressed. While good training lessens the likelihood of a person carrying a firearm with their finger immediately adjacent the trigger, every year there are numerous accidents wherein a person stumbles or slips and inadvertently squeezes the trigger. Likewise, in situations where the firearm is being used in heavily wooded surroundings, there is a risk that an errant branch, etc. may contact the trigger and cause an inadvertent discharge of the weapon if the safety is off. While proper use of the safety should prevent such accidents, they occur, nonetheless.

Thus, it is desirable to find a system and method for actuating a firearm which does not require use of the index finger. It is also desirable to find a system and method for actuating an automatic or semiautomatic weapon which is less susceptible to accidental discharge of the weapon.

SUMMARY OF THE INVENTION

The following summary of the present invention is not intended to describe each illustrated embodiment or every possible implementation of the invention, but rather to give illustrative examples of application of principles of the invention.

In some configurations, the invention may comprise a trigger body having a trigger which extends rearwardly so that the trigger can be actuated by the shooter's thumb.

In some configurations, the firearm may include a pistol grip and a void or compartment may be disposed in or above the rear of the pistol grip with the trigger extending into the void.

In some configurations, the trigger body may include an arm having a catch for engaging a lip on a hammer of the trigger mechanism.

In some configurations, the trigger body may carry a disconnector which has a catch for engaging a lip on the hammer of the trigger mechanism.

In some configurations, the hammer may include an arm having a lip on one side for engaging a disconnector and a lip on the other side for engaging a catch on the trigger body.

These and other aspects of the present invention are realized in the trigger mechanism for firearms which can be actuated by the user's thumb. The trigger mechanism may provide increased safety and potentially increased accuracy while firing the weapon.

BRIEF DESCRIPTION OF THE DRAWINGS

Various embodiments of the present disclosure are shown and described in reference to the numbered drawings wherein.

Figure 1:
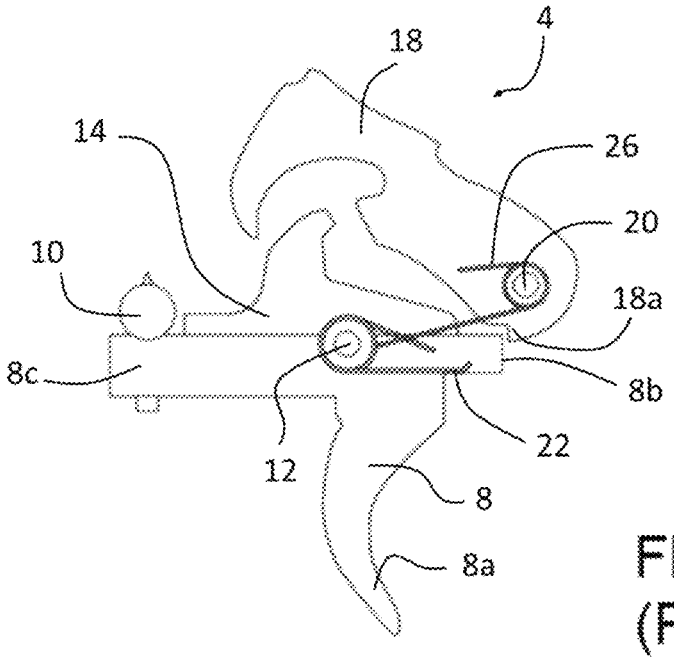
FIG. 1 (Prior Art)
FIGS. 1 through 3 illustrate a side view of the functioning of a trigger mechanism of a conventional semi-automatic rifle.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinary skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without being exactly that quality. For example, a structure said to be generally vertical would be at least as vertical as horizontal, i.e. would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown a side view of the trigger mechanism, generally indicated at 4, of a conventional semi-automatic rifle, such as an AR-15. The trigger mechanism 4 may include a trigger body 8, including a trigger 8*a*, a front face 8*b* and a rear arm or portion 8*c*. Disposed adjacent the rear arm 8*c* is a safety 10. The trigger body 8 pivots about a pin 12 and engages a trigger spring 22 so that trigger 8*a* is biased in a forward position.

Carried partly in the trigger body 8 is a disconnector 14. Disposed toward the front face 8*b* of the trigger body 8 is a hammer 18. The hammer 18 pivots about a pin 20 and is biased into an open or firing position by a hammer spring 26. As will be discussed below, the trigger body 8 and the disconnector 14 selectively hold the hammer 18 in various positions during the firing cycle of the weapon.

In order to use the weapon, the safety 10 is rotated into a fire ready position as shown in FIG. 1. When not in use, the safety 10 is rotated 90° so that the safety body engages the trigger body 8 and prevents the trigger 8*a* from pivoting rearwardly when force is applied thereto. Rotating the safety 10 into the fire position aligns a channel in the safety body with the rear arm 8*c* of the trigger body to thereby enable the trigger body 8 to rotate as the trigger 8*a* is pulled.

Figure 2:
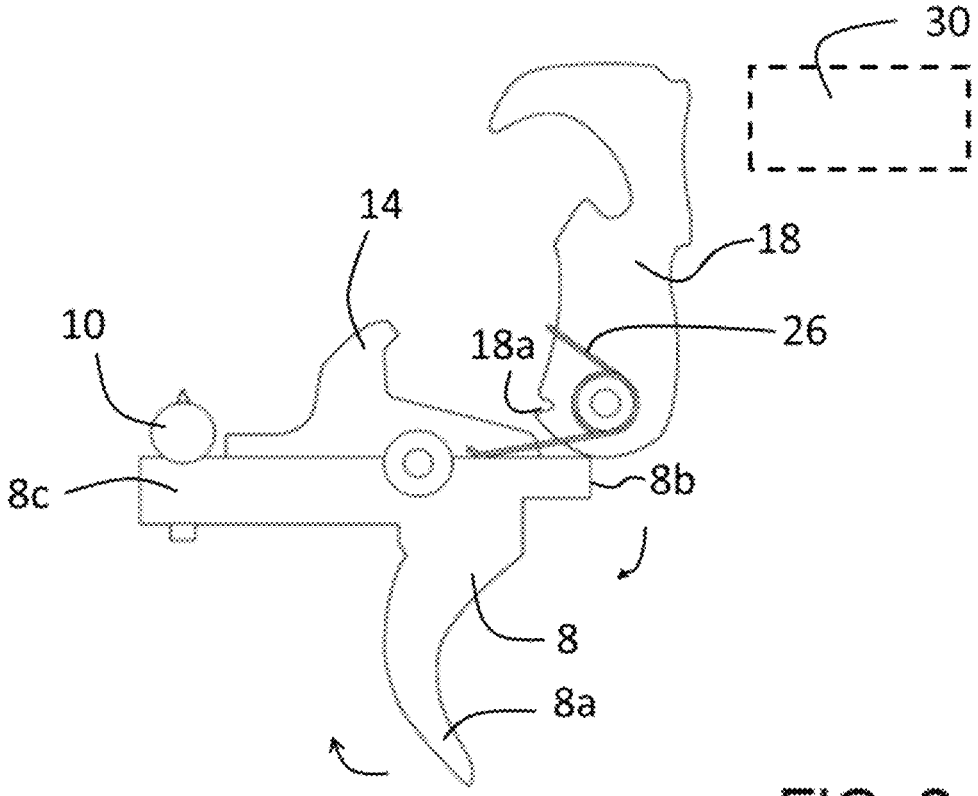
FIG. 2 (Prior Art)

The initial position of the trigger 8 causes a front face 8*b* of the trigger body to engage a sear 18*a* on the hammer 18 to hold the hammer in place. Pulling on the trigger 8 causes the trigger body to rotate with the rear arm 8*b* of the trigger body so that the rear arm moves into a void in the safety, and the front face 8*b* to pivot downwardly out of engagement with the sear 18*a*. This allows the hammer 18 to pivot upwardly and forwardly under the force of the hammer spring 26 and forcefully strike the bolt action assembly 30 to cause the firing pin (not shown) to engage the bullet and cause discharge as shown in FIG. 2.

Figure 3:
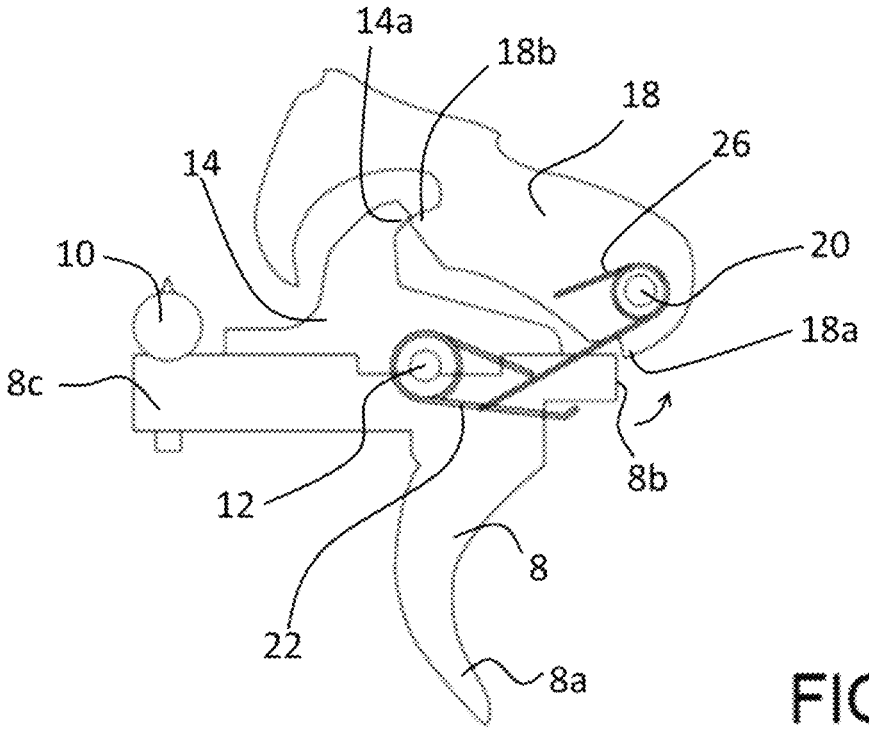
FIG. 3 (Prior Art)

The force of the powder charge in the cartridge behind bullet exploding drives the bolt action assembly 30 rearwardly, pushing the hammer 18 down into the position shown in FIG. 3. The hammer 18 includes a lip 18*b* and the disconnector 14 includes a catch 14*a* which engages the lip to form retaining members when the bolt action assembly 30 pushes the hammer 18 downwardly/rearwardly in FIG. 3. The catch 14*a* momentarily holds the hammer 18 in place while the trigger body 8 rotates back into a position where the front face 8*b* will engage the sear 18*a* on the hammer. As the trigger 8*a* rotates back into place, the catch 14*a* disengages from the lip 18*b* so as to return the hammer 18 into the position shown in FIG. 1.

Figure 4:
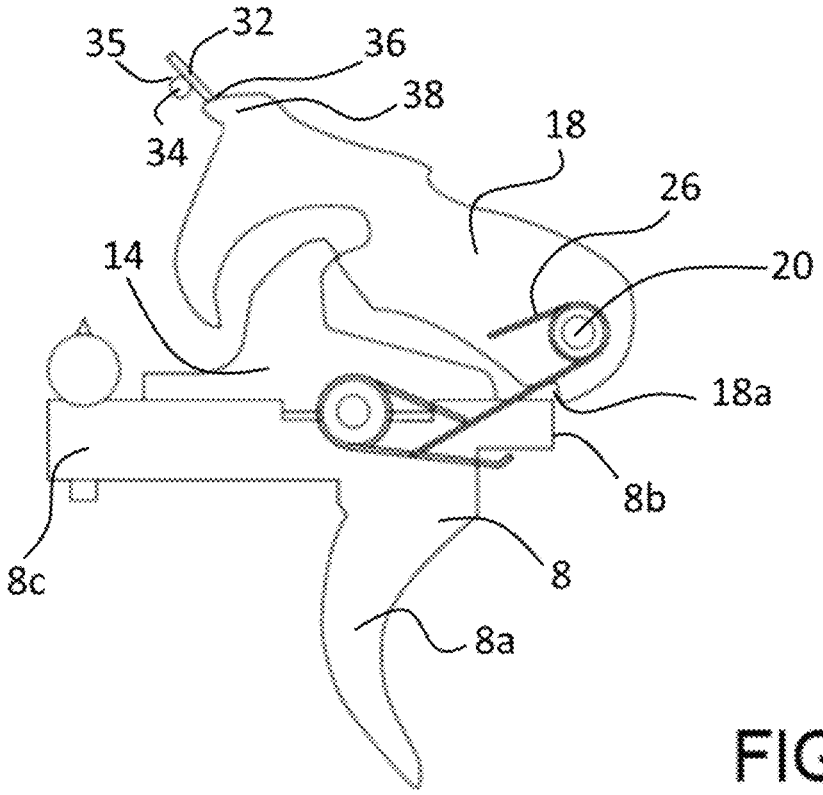
FIG. 4 (Prior Art)
FIG. 4 shows a side view of the functioning of a trigger mechanism of an automatic rifle.

In a fully automatic version, shown in FIG. 4, a second disconnector 32 is disposed above and rearwardly from disconnector 14 and is mounted on a pin 34 which allows the second disconnector to pivot. A spring 35 is used to bias the second disconnector 32 into a downward slope ending in an engagement face 36. The hammer 18 also includes a projection 38 extending from a top end thereof. When the trigger 8*c* is pulled and held down, the rearward thrust of the bolt action assembly 30 pushes the hammer rearwardly until the projection 38 passes the engagement face 36, at which point the second disconnector will hold the hammer 18 in the orientation shown in FIG. 4.

As the bolt action assembly slides forwardly back into position for firing the next round, the bolt action assembly engages the second disconnector 32 and causes the second disconnector to pivot, thereby releasing the hammer 18 from the second disconnector. Once released, the hammer spring 26 drives the hammer 18 back into contact with the bolt action assembly (e.g., the firing pin) to thereby fire the bullet. As long as the trigger 8*a* is held back, the hammer 18 will continue to reengage with and then be released from the second disconnector 32 as the bolt action assembly slides back and forth, thereby firing bullets until either the trigger is released—thereby causing face 8*b* to engage with the sear 18*a*, or until all of the cartridges have been fired.

Figure 5:
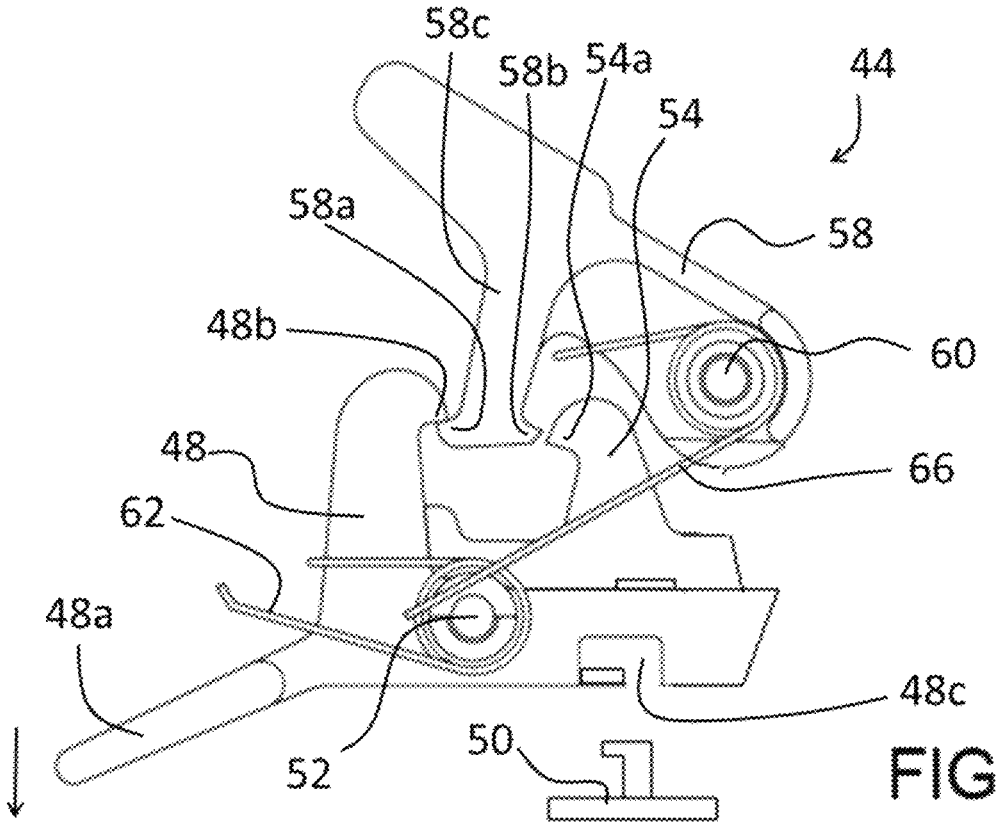
FIG. 5 shows a side view of a trigger mechanism made in accordance with principles of the present invention in a state ready for firing.

Turning now to FIG. 5, there is shown a trigger mechanism generally indicated at 44, made in accordance with the principles of the present invention. The trigger mechanism includes a trigger body 48 which pivots about a trigger pin 52. The trigger body 48 may include a first trigger portion or trigger arm which forms a trigger 48*a*, a second trigger portion or second trigger arm which includes a retention member, such as a trigger catch 48*b*, and a third trigger portion or third trigger arm which forms a safety structure 48*c* (which may be a slot or projection as shown below). The safety structure 48*c* may engage a safety 50 to selectively prevent pivoting of the trigger body 48 about the trigger pin 52. As shown in FIG. 5, the first trigger arm forming the trigger is disposed on one side of the trigger pin 52, while the second trigger arm and third trigger arm are disposed on an opposing side of the trigger pin.

Disposed partially in the trigger body 48 is a disconnector 54. The disconnector 54 may include a retention member, such as a disconnector catch 54*a* which may be configured to engage a first hammer retention member, such as a hammer lip or hammer catch 58*b* on a hammer 58. The hammer 58 may also include a second hammer retention member, such as a second hammer lip or second hammer catch 58*a* which can be engaged by the trigger catch 48*b* on the trigger body 48. The first hammer lip 58*b* and the second hammer lip 58*a* can be disposed on a hammer arm 58*c* extending from the main body of the hammer 18.

Figure 6:
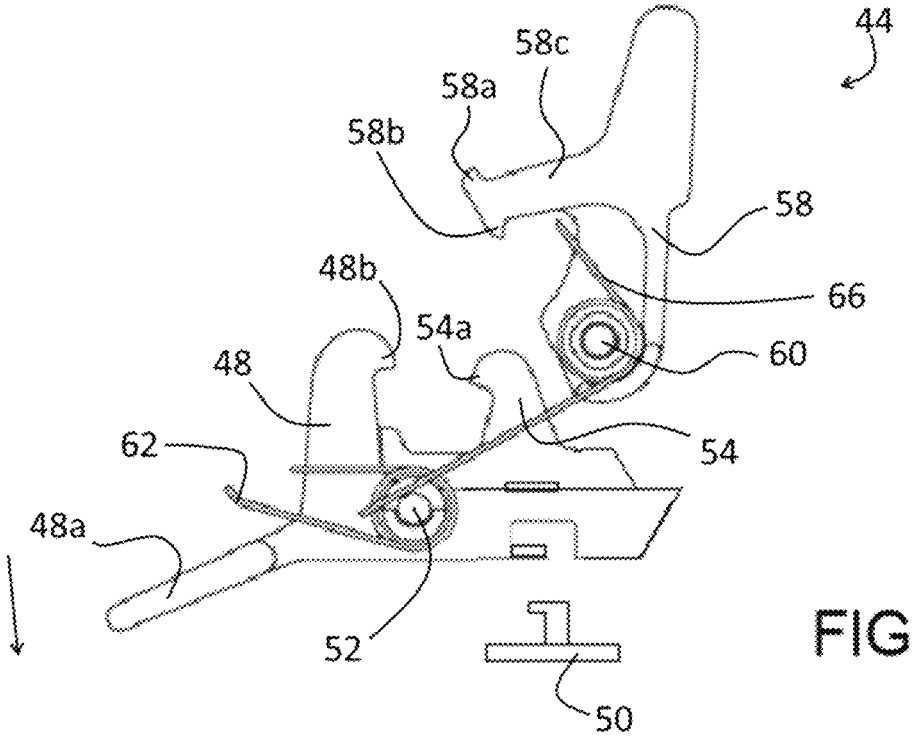
FIG. 6 shows a side view of the trigger mechanism of FIG. 5 in an open, firing position.

As shown in FIG. 5, the trigger mechanism 44 is prepared for firing. By pressing downwardly on the trigger 48*a* as shown in FIG. 6, the trigger body 48 rotates about trigger pin 52 (downwardly on the left side and upwardly on the right) and causes the trigger catch 48*b* to release the second hammer lip 58*a* of the hammer 58. This allows the hammer spring 66 to rotate the hammer 58 about the hammer pin 60 so that the hammer moves forwardly and upwardly to strike the bolt action assembly (not shown) to engage the primer or rim of a cartridge, thereby causing the firing of a bullet.

Figure 7:
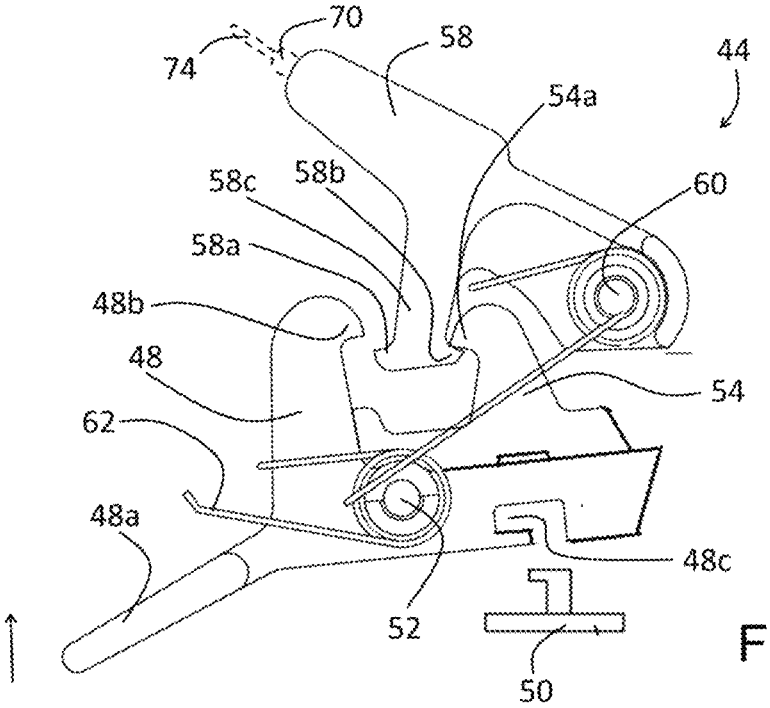
FIG. 7 shows a side view of the trigger mechanism in a return position after firing, but before being ready for firing.

As the bolt action assembly moves rearwardly in response to the explosive force in the cartridge, the bolt action assembly engages the hammer 58 and pushes the hammer rearwardly and downwardly until the first hammer lip 58*b* engages the disconnector catch 54*a* on the disconnector 54 as shown in FIG. 7. The disconnector 54 momentarily holds the hammer 58 by the first hammer lip 58*b* while the trigger body 48 is returning to its normal or rest position. As the trigger catch 48*b* moves forward to reengage the second hammer lip 58*a* on hammer arm 58*c*, the disconnector catch 54*a* is released from the first lip 58*b* on the hammer 58, returning the trigger mechanism 44 to the orientation shown in FIG. 5.

The length of the arm forming the trigger 48*a* can be adjusted to accommodate the receiver in which the trigger mechanism 44 is disposed. In such a configuration a user may fire rounds by pressing on the trigger with their thumb. This enables a person to fire rounds without having to use their index finger. This can be advantageous, for example, if it is very cold and the person is or wearing a glove on their hand. Likewise, it allows the trigger 48 to be positioned so that it is less likely to be interfered with by branches in forests, etc.

It will be appreciated that this configuration may also be used for a fully automatic weapon. For example, the hammer 58 may include a projection 70, and a second disconnector 74 could be provided to maintain firing as long as the bolt action assembly continues to reset the engagement between the projection 70 on the hammer and the second disconnector.

Figure 8:
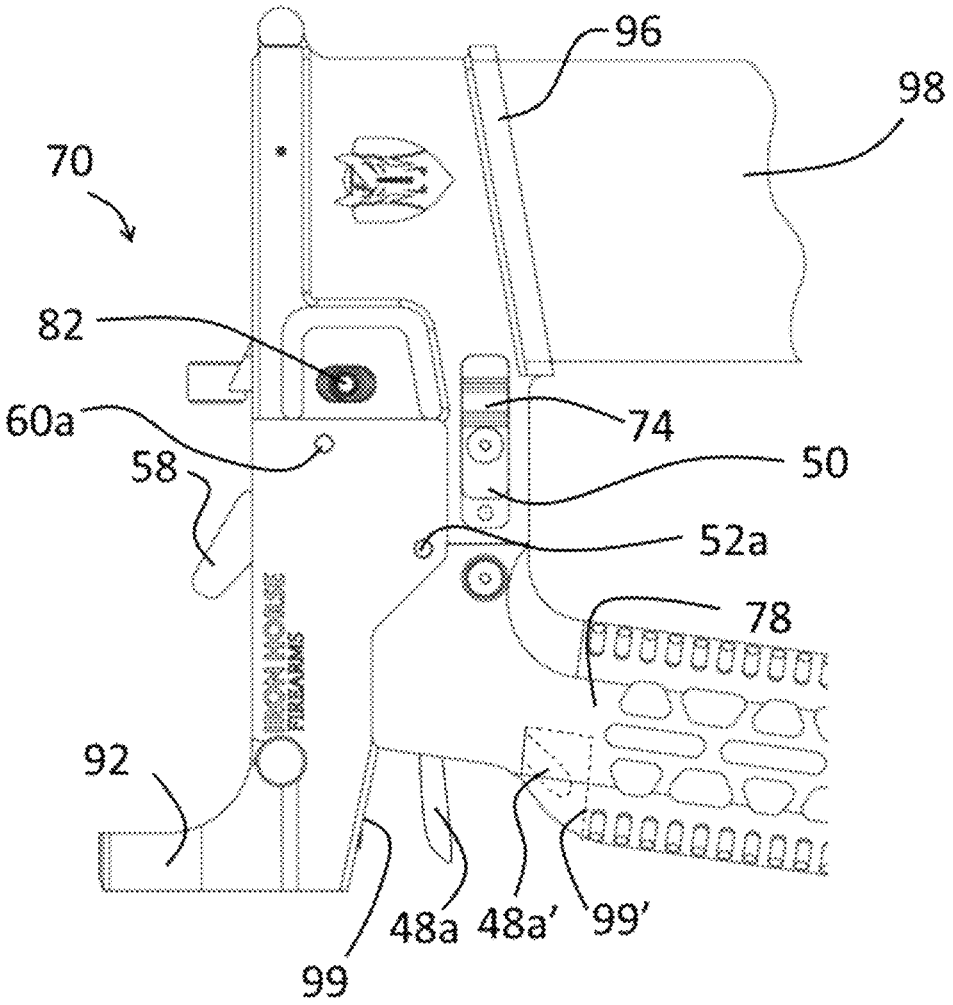
FIG. 8 shows a side view of a lower receiver having a trigger mechanism in accordance with the present invention disposed in a firing position.

Turning now to FIG. 8, there is shown a side view of the lower receiver 80 with the trigger 48 in a ready-to-fire position. The lower receiver 80 includes a first hole 52*a* for receiving the trigger pin 52 (FIGS. 5-7) about which the trigger body 48 pivots. The lower receiver also includes a second hole 60*a* for receiving the hammer pin 60 (FIGS. 5-7) about which the hammer 58 pivots. Also shown on the lower receiver 80 is the safety switch 50. The safety switch may include a plurality of raised surfaces 84 which may be used to slide the safety switch between an initial, safety position (shown in FIG. 8), and an open, fire position caused by moving the safety switch forward. Preferably, the safety switch is constructed so as to give an audible click when the switch is moved between the safety and fire positions so that the shooter knows that the gun is ready to fire. It will be appreciated that the placement of the safety switch allows the user to move it between safety and fire positions with their index finger, thereby allowing the user to keep their hand on the pistol grip 78.

The lower receiver 80 may also include other structures similar to conventional lower receivers. For example, the lower receiver 80 includes a hole 82 for mounting the bolt catch (not shown), a hole 88 for receiving the pivot pin for attachment to the upper receiver, and the mount 92 for attachment of the butt stock assembly (not shown). The lower receiver 80 also includes a magazine compartment 96 for receiving a magazine 98 of bullets.

Toward the back of the receiver is a void or chamber 99 which extends inwardly. The trigger 48*a* forms a lever disposed in the void so that the shooter can fire the weapon by pressing on the lever with his or her thumb. While shown in FIG. 8 as being above the pistol grip 78, it will be appreciated that the arm or lever forming the trigger 48' could be at a different angle and length so that it extends down into a void or chamber 99' in the rear of the pistol grip.

Figure 9:
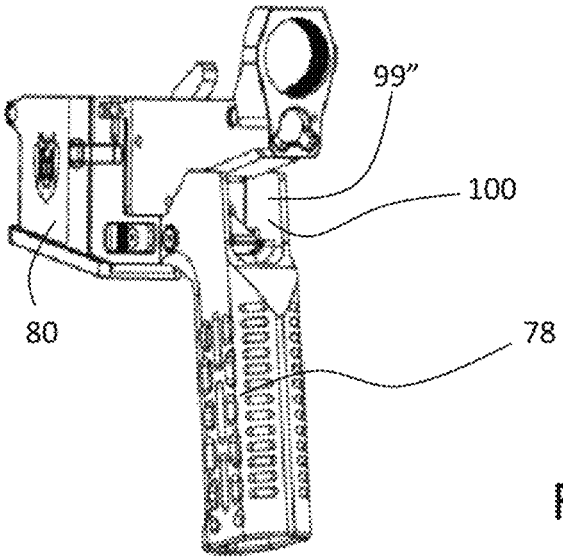
FIG. 9 shows a rear perspective view of an alternate configuration of the lower receiver and pistol grip.

FIG. 9 shows an alternate configuration of the lower receiver 80 and the pistol grip 78. The void or chamber 99" has closed sidewalls 100 to further protect a trigger (not shown) disposed inside.

Figure 10:
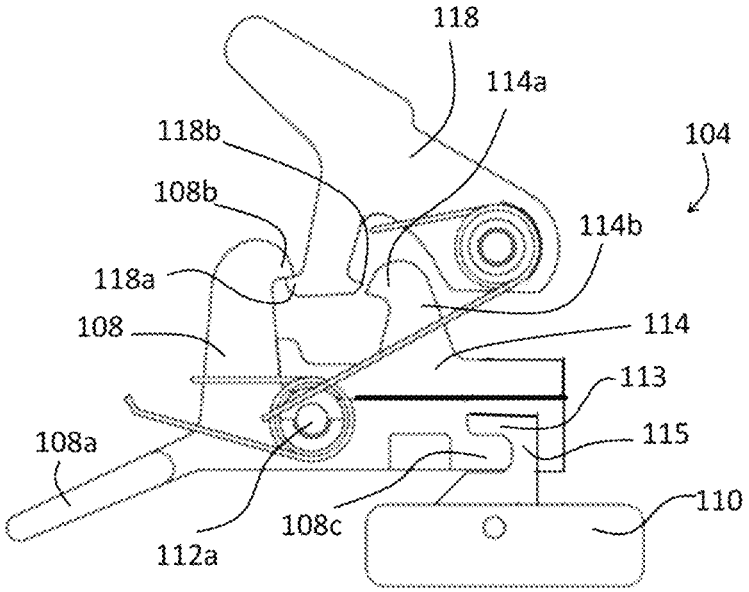
FIG. 10 shows a side view of the trigger mechanism in a reset position after firing.

FIG. 10 shows a side view of an alternate configuration of the trigger mechanism, generally indicated at 104. The trigger mechanism 104 includes the trigger body 108 which includes a first arm or lever forming the trigger 108*a* and extending downwardly at an angle. The trigger body 108 further includes a second arm which may extend generally vertically (i.e., about 110-130 degrees from the first arm) along which the catch 108*b* is disposed. A third arm extends forwardly (i.e., about 140-170 degrees from the first arm) on a side opposite the hole 112*a* into which the trigger body pin is disposed. The third arm receives the disconnector 114 and has a safety structure 108*c* in the form of a projection 113 disposed along the arm. The safety 110 includes an arm 115 which selectively engages the projection for engaging the projection 113 such that when the arm engages the projection, the trigger body 108 cannot pivot upwardly with the third arm or downwardly with the first arm forming the trigger 108*a*. The safety 110 may also include a detent pin (i.e., a pin which nests in an indentation in the lower receiver) so as to provide an auditory indication when the safety is been moved into the fire position.

The disconnector 114 rides on/in the third arm, such that pressing downwardly on the trigger 108*a* moves the third arm and the disconnector upwardly. This facilitates the engagement of the engagement members (catch 114*a* disposed on the arm 114*b* and lip 118*b* on the arm 118*c* of the hammer 118) momentarily engaging while the other engagement members reengage. In other words, trigger 108 body pivots back into its original position, where the catch 108*b* engages and holds the second lip 118*a* on the arm 118*c* of the hammer 18. It will be appreciated that the relative orientations of the portions or arms of the trigger body 108 can be adjusted to change the position of the trigger 108*a* depending on its desired position.

Figure 11:
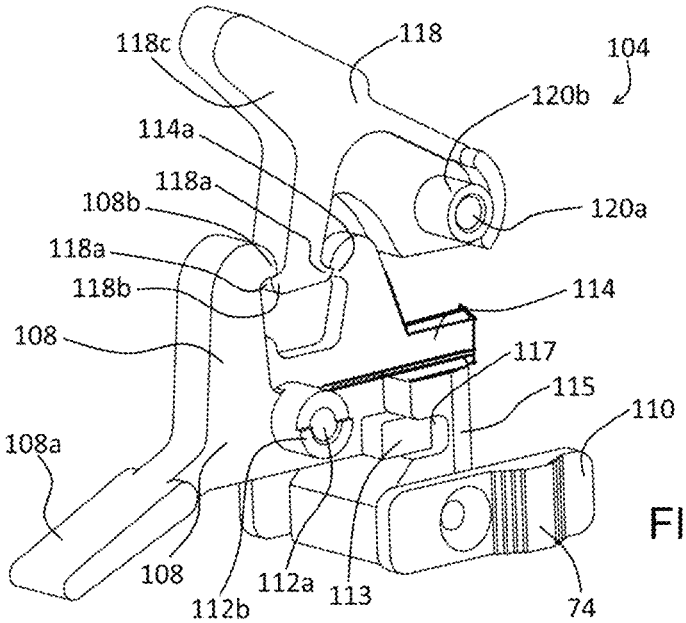
FIG. 11 shows a rear perspective view of the side view of the lower receiver with the trigger in a ready-to-fire position.

Turning now to FIG. 11, there is shown a rear perspective view of the trigger mechanism 104. The manner in which the projection 113 on the third arm or portion of the trigger body 108 is received into a notch 117 in the arm 115 of the safety 110 can clearly be seen. Moving the safety 110 forward, such as pushing forward on the raised surfaces 74 moves the projection 113 out of the notch (or the arm from around the projection to be more specific) and allows the trigger body 108 to pivot.

The position of the trigger body 108, the disconnector 114 and the hammer 118 shown in FIG. 11 is consistent with the position of those structures immediately after the bolt action assembly (not show) has moved rearwardly to return the hammer 118, but prior to rotation of the trigger 108*a* upwardly enough that the engagement member or catch 114*a* on the disconnector releases the engagement member or first lip 118*b* on the arm 118*c* of the hammer and the engagement member or catch 108*b* on the trigger body reengages the engagement member or second lip 118*a* on the hammer body. It will be appreciated that cycling from the initial pre-firing orientation, to the firing position (where the hammer strikes the bolt action assembly), into the orientation shown in FIG. 11 and back into the original pre-firing position takes a mere fraction of a second.

Also shown in FIG. 11 are the shoulders 112*b* and 120*b* which surround the holes 112*a* and 120*a* which hold the pins for the trigger body 108 and the hammer 118, respectively. The shoulders are provided for mounting the trigger body spring and the hammer body spring discussed above.

Figure 12:
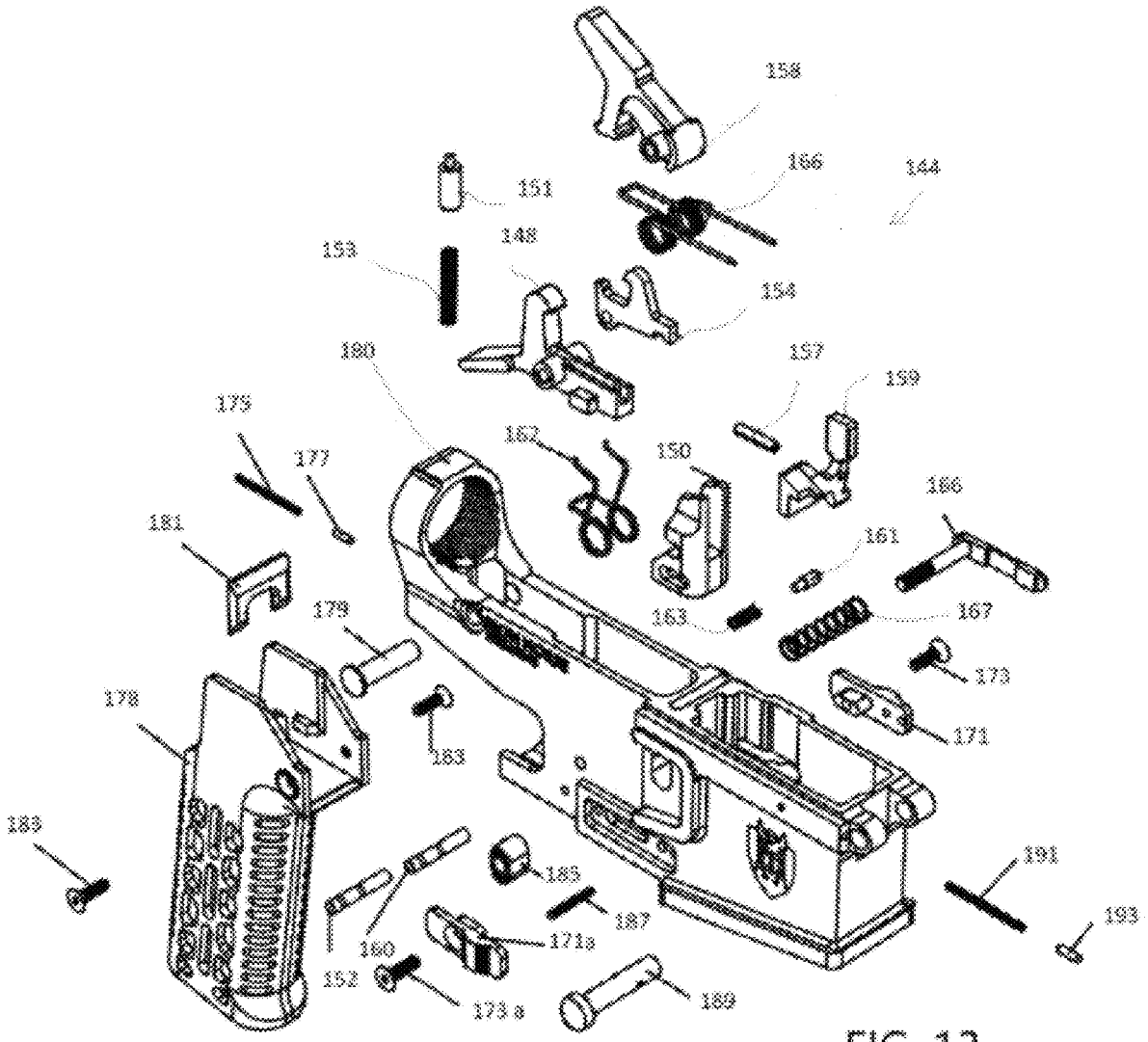
FIG. 12 shows an exploded view of a thumb operated receiver.

Turning now to FIG. 12, there is shown an exploded view of a lower receiver 180 and trigger mechanism 144. At the top of the figure is the hammer 158 just above a hammer spring 166 which biases the hammer into a firing position. Below the hammer spring 166 is the disconnector 154 which can be positioned in the slot of the trigger body 148. To the left of the trigger body are the buffer retainer 151 and the buffer retainer spring 153.

To the right and down from the trigger body 48 is a bolt catch roller pin 157 and a bolt catch 159. Below the bolt catch 159 is the bolt catch plunger 161 and the bolt catch spring 163. Further to the right are the magazine catch 165 and the magazine catch spring 167. A safety selector 171 and safety screw 173 can be positioned on one side of the receiver 180, while a second safety selector 171*a* and second safety screw 173*a* can be positioned on the other side so that the safety may be actuated on either side of the receiver. Positioned below the trigger body 148 is the trigger spring 162 and the safety 150 which is engaged by the safety selector 171 to selectively engage the projection on the trigger body 148.

Disposed to the left of the lower receiver 180 is the take down pin spring 175 and the take down pin detent 177, while the take down 179 pin is disposed just under the left end of the lower receiver 180. Just below the take down pin spring 175 and the take down spring detent 177 is the gas shield 181 which may nest in the open top portion of the grip 178 and may include channel for the trigger to pass through. The grip 178 may be attached to the lower receiver 180 by a pair of grip screws 183.

Disposed adjacent to the grip 178 are the trigger pin 152 and the hammer pin 160. Adjacent the pins 152 and 160 are the magazine release button 185 and the safety selector spring 187. Adjacent the safety selector spring 187 is the pivot pin 189. Disposed at the right end of the lower receiver 180 are the pivot pin spring 191 and the pivot pin detent 193.

Figure 13:
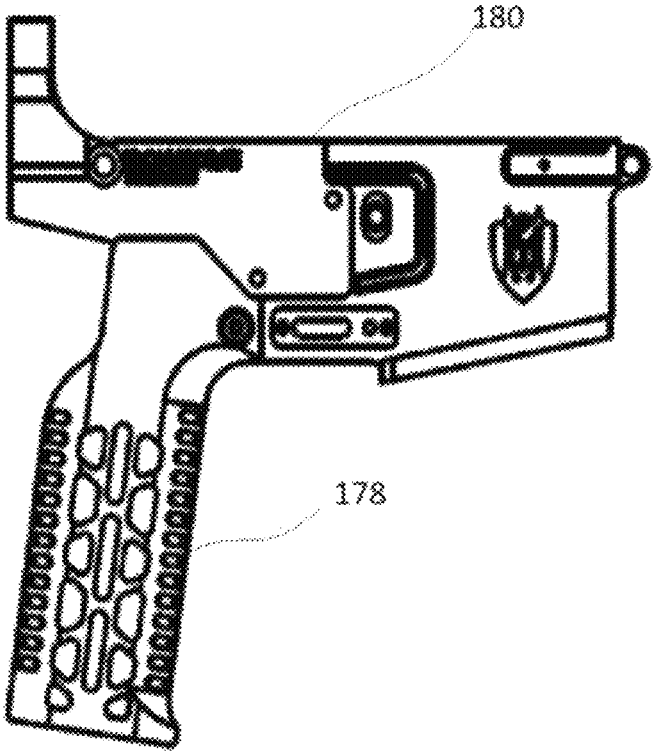
FIG. 13 shows a side view of the thumb operated receiver of FIG. 12.

FIG. 13 is a side view of the lower receiver 180 and the pistol grip 178. In use, the shooter would insert their thumb into the void at the top of the pistol grip 178 (viewable in FIG. 12) to push down on the trigger and fire the gun.

While discussed in the context of semiautomatic and automatic firearms, it will be appreciated that the trigger of a conventional firearm which is neither semiautomatic or automatic could be configured to use a trigger that includes a lever or arm which extends rearwardly so that it is disposed in or adjacent the rear of the handle of the weapon so that the lever can be engaged by the shooter's thumb, thereby firing the weapon.

Thus, there is disclosed a trigger mechanism for firearms. It will be appreciated that numerous modifications may be made without departing from the scope and spirit of this disclosure. The appended claims are intended to cover such modifications.

What is claimed is:

1. A firearm receiver having a rear end portion to which a butt stock may be attached, an upper portion for connection to an upper receiver and a lower portion for attachment to a pistol grip, the firearm receiver comprising:

a trigger mechanism including:

a trigger body pivotally mounted at a pivot point in the firearm, the trigger body including a first arm forming a trigger extending rearwardly from the pivot point, and a second arm extending upwardly from the pivot point and having a catch;

a hammer pivotally disposed in the firearm, the hammer including a lip for selectively engaging the catch; and;

wherein the first arm and the second arm of the trigger body are both disposed completely rearwardly of the pivot point.

2. The firearm of claim 1, wherein the trigger body includes a third arm and further comprising a disconnector disposed on the third arm.

3. The firearm of claim 2, wherein the hammer includes an arm extending generally rearwardly and downwardly, and wherein the arm includes the lip for selectively engaging the catch and a second lip for selectively engaging the disconnector.

4. The firearm of claim 1, where in the third arm and a disconnector are disposed primarily forward of the pivot point of the trigger body and wherein the disconnector is movable with respect to the third arm.

5. A firearm receiver having a rear end portion to which a butt stock may be attached, an upper portion for connection to an upper receiver and a lower portion for attachment to a pistol grip, the firearm receiver comprising:

a trigger mechanism including:

a trigger body pivotally mounted at a pivot point in the firearm, the trigger body including a first arm forming a trigger extending rearwardly from the pivot point, and a second arm extending upwardly from the pivot point and having a catch;

a hammer pivotally disposed in the firearm, the hammer including a lip for selectively engaging the catch;

wherein the trigger body includes a third arm and further comprising a disconnector disposed on the third arm; and;

a safety structure formed in a lower portion of the third arm; and wherein the firearm further comprises a safety for engaging the safety structure to prevent pivoting of the trigger body.

6. A firearm receiver having a rear end portion to which a butt stock may be attached, an upper portion for connection to an upper receiver and a lower portion for attachment to a pistol grip, the firearm receiver comprising:

a trigger mechanism including:

a trigger body pivotally mounted at a pivot point in the firearm, the trigger body including a first arm forming a trigger extending rearwardly from the pivot point, and a second arm extending upwardly from the pivot point and having a catch; and a hammer pivotally disposed in the firearm, the hammer including a lip for selectively engaging the catch; and;

further comprising a pistol grip and wherein the trigger extends to the rear of the pistol grip.

7. The firearm of claim 6, where a void is disposed in or above the pistol grip, the void extending inwardly from a rear side, and wherein the trigger extends into the void.

8. The firearm of claim 6, wherein the trigger body is formed from a single piece and directly engages the hammer.

9. A firearm comprising a receiver and a pistol grip attached to the receiver, the receiver and the pistol grip having a rearward side and a void disposed in the pistol grip or the receiver and opening rearwardly, a trigger body, the trigger body being formed from a single piece of material and including a trigger extending into the void and a hammer arm for engaging a hammer disposed within the receiver, and a third arm for carrying a disconnector; and wherein the void is sized and oriented to receive a shooter's thumb.

10. The firearm of claim 9, wherein the trigger is formed by a generally straight, downwardly extending arm.

11. The firearm of claim 9, wherein the trigger does not extend beyond the void.

12. The firearm of claim 9, wherein the firearm lacks a trigger guard in front of the pistol grip.

13. A firearm comprising a receiver and a pistol grip attached to the receiver and extending downwardly therefrom, the receiver and the pistol grip having a rearward side and a void disposed in the pistol grip or the receiver and opening rearwardly;

a trigger body disposed to pivot about a pivot point, the trigger body comprising a trigger arm extending downwardly adjacent to the pistol grip and into the void, a second arm extending generally upwardly away from the pistol grip, the second arm having a catch thereon, and a third arm disposed on a side of the pivot point opposite the trigger arm.

14. The firearm of claim 13, further comprising a disconnector disposed on the third arm, the firearm further comprising a hammer having a first lip for engaging the disconnector and a second lip for engaging the catch on the second arm.

15. The firearm of claim 14, wherein the hammer has an arm, the arm having the first lip on one side thereof and the second lip on the second side thereof.

16. The firearm of claim 13, wherein the third arm has a safety structure formed in the trigger body and a safety disposed on the receiver for engaging the safety to prevent pivoting of the trigger body.

17. The firearm receiver of claim 1, wherein all of the trigger is disposed rearwardly of the pivot point.

18. The firearm receiver of claim 1, wherein the trigger body is one piece.

19. The firearm receiver of claim 1, further comprising a disconnect carried by but moveable independent of the trigger body.

* * * * *